US012063995B2

(12) United States Patent
Takahashi

(10) Patent No.: US 12,063,995 B2
(45) Date of Patent: Aug. 20, 2024

(54) GLOVE

(71) Applicant: SHOWA GLOVE CO., Hyogo (JP)

(72) Inventor: Nobuaki Takahashi, Hyogo (JP)

(73) Assignee: SHOWA GLOVE CO., Hyogo (JP)

( * ) Notice: Subject to any disclaimer, the term of this patent is extended or adjusted under 35 U.S.C. 154(b) by 105 days.

(21) Appl. No.: 17/283,529

(22) PCT Filed: Oct. 9, 2019

(86) PCT No.: PCT/JP2019/039861
§ 371 (c)(1),
(2) Date: Apr. 7, 2021

(87) PCT Pub. No.: WO2020/080226
PCT Pub. Date: Apr. 23, 2020

(65) Prior Publication Data

US 2021/0386146 A1 Dec. 16, 2021

(30) Foreign Application Priority Data

Oct. 17, 2018 (JP) ..... 2018-196124

(51) Int. Cl.
*A41D 19/00* (2006.01)

(52) U.S. Cl.
CPC ..... *A41D 19/0048* (2013.01); *A41D 19/0006* (2013.01)

(58) Field of Classification Search
CPC ..... A41D 19/0048; A41D 19/0006; A41D 19/015; A41D 19/0017; A41D 19/0044; A41D 19/00034; A41D 19/01594
See application file for complete search history.

(56) References Cited

U.S. PATENT DOCUMENTS 3,952,333 A * 4/1976 Fujita ..... A63B 71/146 2/161.5
4,040,126 A * 8/1977 Cecil ..... A63B 71/146 2/161.5

(Continued)

FOREIGN PATENT DOCUMENTS

JP 57-90178 U 6/1982
JP 7-313653 A 12/1995

(Continued)

OTHER PUBLICATIONS

EESR dated Jun. 30, 2022 issued in corresponding EP Patent Application No. 19873221.6.

*Primary Examiner* — Richale L Quinn
(74) *Attorney, Agent, or Firm* — Norris McLaughlin, P.A.

(57) ABSTRACT

An object of the present invention is to provide a glove in which a hand can be easily inserted and removed through an opening and which is less likely to shift from a suitable position when the glove is in a wearing state. An aspect of the present invention is a glove including: a glove main body having an opening through which a wearer's hand is able to be inserted and removed and a notch which extends from the opening toward a fingertip side, the glove main body covering the hand; a tongue piece, one end of which is fastened to the glove main body on a dorsal side of the hand with respect to a palm surface and on a thumb side with respect to the notch, and an other end of which is a free end; and a restricting portion which is fastened to the glove main body and is capable of restricting movement of the free end of the tongue piece on the dorsal side of the hand with respect to the palm surface and on a pinky finger side with respect to the notch, wherein on the dorsal side of the hand with respect to the palm surface and on the thumb side with respect to a middle finger, the notch extending from the opening toward the fingertip side is formed in the glove main body, and the (Continued)

restricting portion is configured to enable restricting such that the free end is positioned on the fingertip side with respect to the one end of the tongue piece.

4 Claims, 7 Drawing Sheets

(56) References Cited

U.S. PATENT DOCUMENTS 4,701,963 A * 10/1987 Overton ..... A41F 1/06 2/167
5,295,269 A * 3/1994 Ballard ..... A41D 19/01523 2/161.1
5,444,874 A * 8/1995 Samelian ..... A41D 19/0013 2/917
5,517,694 A * 5/1996 Fabry ..... A41D 19/01582 2/161.4
5,537,692 A * 7/1996 Dorr ..... A41D 19/01588 2/161.1
5,740,555 A * 4/1998 Renegar ..... A41D 19/0037 2/161.4
6,010,473 A * 1/2000 Robinson ..... A63B 23/16 128/880
6,105,162 A * 8/2000 Douglas ..... A41D 13/0562 2/161.1
6,253,382 B1 * 7/2001 Kleinert ..... A63B 71/143 2/163
6,415,445 B1 * 7/2002 Nishijima ..... A63B 71/146 2/161.4
6,427,247 B1 * 8/2002 Suk ..... A63B 71/146 2/161.1
6,728,971 B1 * 5/2004 Benavidez ..... A63B 71/146 2/161.4
7,930,768 B1 * 4/2011 Tyler ..... A42B 1/041 2/205
8,256,028 B1 * 9/2012 Ibon ..... A41D 19/00 2/161.1
8,359,667 B2 * 1/2013 Clark ..... A41D 19/0048 2/161.4
8,726,418 B2 * 5/2014 DeBlasis ..... A41F 1/06 2/161.1
10,004,975 B2 * 6/2018 Clement ..... A63B 71/145
10,111,477 B1 * 10/2018 Ballas ..... A41F 1/06
10,925,334 B1 * 2/2021 Husser ..... A41D 19/0048
11,000,085 B2 * 5/2021 Rodriguez ..... A41D 27/12
11,076,649 B2 * 8/2021 Iacono ..... A41D 19/0065
11,134,732 B2 * 10/2021 Iacono ..... A63B 71/143
2003/0005506 A1 * 1/2003 Litke ..... A63B 71/146 2/161.2
2006/0143767 A1 * 7/2006 Yang ..... B32B 7/04 442/76
2006/0212990 A1 9/2006 Mattesky
2006/0230493 A1 * 10/2006 Corry ..... A63B 69/3608 2/159
2007/0067891 A1 * 3/2007 Schauffele ..... A63B 71/146 2/161.1
2007/0174948 A1 * 8/2007 Robba ..... A63B 71/146 2/161.1
2007/0226872 A1 * 10/2007 Huh ..... A41D 19/0024 2/159
2007/0226873 A1 * 10/2007 Mattesky ..... A41D 19/0058 2/159
2008/0010719 A1 * 1/2008 Hoelscher ..... A41D 19/01588 2/161.1
2008/0276348 A1 * 11/2008 England ..... A63B 71/146 2/160
2009/0038052 A1 * 2/2009 Gellis ..... A41D 19/01558 2/163
2009/0100573 A1 * 4/2009 Coulter ..... A63B 71/141 2/163
2010/0275342 A1 * 11/2010 Sweeney ..... D04B 1/28 2/167
2012/0245503 A1 * 9/2012 DeVries ..... A41D 19/015 602/21
2013/0000006 A1 * 1/2013 Norton ..... A63B 71/145 2/16
2013/0036523 A1 * 2/2013 Webster ..... A41D 19/01523 2/19
2013/0167281 A1 * 7/2013 Jennings ..... B29C 35/002 156/196
2013/0198920 A1 * 8/2013 Wittman ..... A41D 13/081 2/16
2013/0227755 A1 * 9/2013 Bisaillon ..... A41D 19/0048 2/161.1
2013/0263356 A1 * 10/2013 Jones ..... A63B 71/148 2/163
2013/0283498 A1 * 10/2013 Hewitt ..... A41D 19/0048 2/163
2014/0059739 A1 * 3/2014 Gellis ..... A41D 19/0048 2/168
2014/0215685 A1 * 8/2014 Bush ..... A63B 71/146 2/161.1
2015/0143608 A1 * 5/2015 Loo ..... B29D 99/0067 2/169
2015/0181955 A1 * 7/2015 Hughes ..... A41D 19/01523 66/174
2015/0314189 A1 * 11/2015 Le ..... A63B 71/143 2/16
2016/0367881 A1 * 12/2016 Le ..... A41F 1/06
2017/0282048 A1 * 10/2017 Wittman ..... A63B 71/145
2018/0154622 A1 * 6/2018 Howland ..... A41D 19/015
2018/0193718 A1 * 7/2018 Gilday ..... A41D 19/01564
2018/0249773 A1 * 9/2018 Isobe ..... A41D 19/0006
2018/0255849 A1 * 9/2018 Paquette ..... A63B 71/143
2020/0405320 A1 * 12/2020 Kawamoto ..... A61B 17/12009
2021/0007873 A1 * 1/2021 Frederick ..... A63B 71/141
2021/0052968 A1 * 2/2021 Ciaglia ..... A63B 71/141
2021/0378332 A1 * 12/2021 Tryner ..... A41D 19/0048
2022/0088464 A1 * 3/2022 Kawiya ..... A63B 71/146
2022/0212087 A1 * 7/2022 Kucharsky ..... A63B 71/143

FOREIGN PATENT DOCUMENTS

JP 2011-6809 A 1/2011
JP 2015-129362 A 7/2015
WO 2009/057524 A1 5/2009

* cited by examiner

GLOVE

TECHNICAL FIELD

The present invention relates to a glove.

BACKGROUND ART

As gloves, for example, work gloves for use in work at a factory and the like, in a carrying task, in an agricultural job, and the like are known. As this type of a work glove, a coated glove in which a cover layer made of a resin or a rubber is overlaid on an outer face of a glove main body being made of fibers and covering a wearer's hand is known (see Japanese Unexamined Patent Application, Publication No. 2015-129362). In this type of coated glove, the glove main body has an opening through which the hand can be inserted or removed (insertion and removal are possible), and the coated glove is put on the wearer's hand by inserting the hand through the opening.

However, in a case in which the coated glove fits to the wearer's hand, a glove-donning motion of inserting the hand through the opening and/or a removal motion of removing the hand through the opening may be cumbersome. Meanwhile, in a case in which a coated glove having a size that allows easy insertion and removal of the hand is worn, as work with the glove being worn is continued, an actual wearing position of the glove is likely to shift from a suitable wearing position during the work, disturbing the work that the wearer intends to carry out.

PRIOR ART DOCUMENTS

Patent Documents

Patent Document 1: Japanese Unexamined Patent Application, Publication No. 2015-129362

SUMMARY OF THE INVENTION

Problems to be Solved by the Invention

In view of the aforementioned circumstances, the inventors of the present invention have conceived of forming, on a hand dorsal side of a glove main body, a notch extending from an opening toward a fingertip side, and providing a tongue piece enabling opening and closing of the notch. Specifically, the inventors have conceived of a glove in which one end of the tongue piece is fastened to the glove main body on a pinky finger side with respect to the notch, the other end of the tongue piece is a free end, and a restricting portion capable of restricting movement of the free end (an attaching/detaching portion which is attachable to and detachable from the free end) is provided in the glove main body on a thumb side with respect to the notch. In a motion of donning the glove on the hand, the glove is in a state in which the movement of the free end is not restricted by the restricting portion, enabling the opening to be expanded owing to the presence of the notch and thus the glove to be easily worn on the hand. Furthermore, the movement of the free end is restricted by the restricting portion after the hand is inserted, whereby expansion of the opening can be suppressed by the tongue piece.

However, it has been found that in a case in which the above-described glove having the tongue piece is used in actual work, an actual wearing position of the glove is likely to shift from a suitable position during the work.

The present invention has been made in view of the foregoing problems, and an object of the present invention is to provide a glove in which a hand can be easily inserted and removed through an opening, and which is less likely to shift from a suitable position when the glove is in a wearing state.

Means for Solving the Problems

An aspect of the invention made to solve the aforementioned problems is a glove including: a glove main body having an opening through which a wearer's hand is able to be inserted and removed and a notch which extends from the opening toward a fingertip side, the glove main body covering the hand; a tongue piece, one end of which is fastened to the glove main body on a dorsal side of the hand with respect to a palm surface and on a thumb side with respect to the notch, and an other end of which is a free end; and a restricting portion which is fastened to the glove main body and is capable of restricting movement of the free end of the tongue piece on the dorsal side of the hand with respect to the palm surface and on a pinky finger side with respect to the notch, wherein on the dorsal side of the hand with respect to the palm surface and on the thumb side with respect to a middle finger, the notch is formed in the glove main body, and the restricting portion is configured to enable restricting such that the free end is positioned on the fingertip side with respect to the one end of the tongue piece.

In the glove, in a state in which the movement of the free end of the tongue piece is not restricted by the restricting portion (hereinafter, may be also referred to as a free state), the opening can be expanded owing to the presence of the notch, and the hand can thus be easily and certainly inserted and removed. Furthermore, by bringing the glove into a state in which the movement of the free end of the tongue piece is restricted by the restricting portion after insertion of the hand (hereinafter may be also referred to as a restricted state), the glove can be worn on the hand in a state in which expansion of the opening is suppressed. In the glove, the one end of the tongue piece is fastened to the glove main body on the thumb side with respect to the notch, and the free end of the tongue piece can be restricted by the restricting portion so as to be positioned on the fingertip side with respect to the one end; accordingly, an actual wearing position of the glove in the restricted state is less likely to shift from a suitable position. In other words, by wearing the glove such that on the dorsal side of the hand, a portion on the thumb side and the opening side of the glove main body and a portion on the pinky finger side and the fingertip side of the glove main body are tightened by the tongue piece, a wearing state with an appropriate fit, in which the thumb, the index finger, and the middle finger are less likely to be misaligned, can be obtained.

In the glove, it is preferred that the glove main body is made of fibers, and the glove preferably further includes a cover layer made of a resin or a rubber which is overlaid on at least a palm region of an outer face of the glove main body. Accordingly, the glove can be suitably used as a coated glove for use in various types of work.

In a case in which the glove includes the cover layer as described above, the one end of the tongue piece is preferably fastened, by sewing, to a site of the glove main body on which the cover layer is overlaid. In this manner, not only the glove main body made of fibers but also the cover layer are present in a fastening portion at which the tongue piece is fastened to the glove main body, reinforcing a fastening state of the tongue piece.

In the glove, it is preferred that the restricting portion is one hook-and-loop fastener, and that the tongue piece includes an attaching/detaching portion including an other hook-and-loop fastener which is attachable to and detachable from the one hook-and-loop fastener. Accordingly, the free end of the tongue piece can be easily and certainly restricted and released by attaching and detaching a pair of hook-and-loop fasteners (the one hook-and-loop fastener and the other hook-and-loop fastener), and furthermore, a degree of tightening by the tongue piece can be changed by changing a position at which the hook-and-loop fasteners attach to and detach from one another, i.e., by adjusting a position at which the other hook-and-loop fastener is restricted (engaged) with respect to the one hook-and-loop fastener.

In the glove, the glove main body is preferably seamless. Accordingly, the glove main body can be easily and certainly produced.

It is to be noted that the "dorsal side of the hand with respect to the palm surface" as referred to herein means, in a state in which a hand wearing the glove grips an item, a side that does not contact the gripped item, and includes not only a hand dorsal portion (a portion opposite to the palm) but also a side face portion of the glove main body. As referred to herein, the "hand dorsal portion" means, in a state in which the hand wears the glove with the fingers stretched out (a state in which the palm surface contacts a flat surface), the dorsal side of the hand (a side opposite to the palm) with respect to a plane connecting a metacarpal of the thumb to a metacarpal of the pinky finger. Furthermore, the "palm surface" as referred to herein means, in the state in which the hand wears the glove, a plane which contacts a flat surface when a palm side contacts the flat surface. Furthermore, the "side face portion of the hand" as referred to herein means, in the state in which the hand wears the glove, a portion of the glove main body which is visible from the palm side, not including the palm surface. Furthermore, the "thumb side with respect to the middle finger" as referred to herein means, when viewed from the dorsal side of the hand, the thumb side with respect to a center line of the middle finger and includes the side face portion of the glove main body. The expression "the free end is positioned on the fingertip side with respect to the one end of the tongue piece" as referred to herein means that, when the free end is in the restricted state, a center of a restricted site at which the tongue piece is restricted by the restricting portion is positioned on the fingertip side (a side opposite to the opening side) with respect to a center of a fastening site at which the tongue piece is fastened to the glove main body (a center of the one end). The "center of the fastening site at which the tongue piece is fastened to the glove main body" means a midpoint of the fastening site in a case in which the fastening site has a linear shape (for example, in a case in which the tongue piece is fastened to the glove main body in a linear manner by sewing or the like), and means a center of gravity of the fastening site in a case in which the fastening site has a planar shape (for example, in a case in which the tongue piece is fastened to the glove main body in a planar manner using an adhesive or the like). Furthermore, the "center of the restricted site at which the tongue piece is restricted by the restricting portion" means a center of gravity of the restricted site in a case in which the restricted site has a planar shape (for example, in a case in which the restricting portion and the tongue piece are restricted by the pair of the hook-and-loop fasteners), and means a midpoint of the restricted site in a case in which the restricted site has a linear shape (for example, in a case in which the tongue piece is restricted in a linear manner by folding back the tongue piece inserted into the restricting portion, which is constituted from a ring-shaped member).

Effects of the Invention

As described above, the glove has the following effects: the hand can be easily inserted and removed through the opening; and the glove in a wearing state is less likely to shift from a suitable position.

DESCRIPTION OF EMBODIMENTS

Hereafter, embodiments of the present invention are described in detail with reference to the drawings as appropriate.

Figure 1:
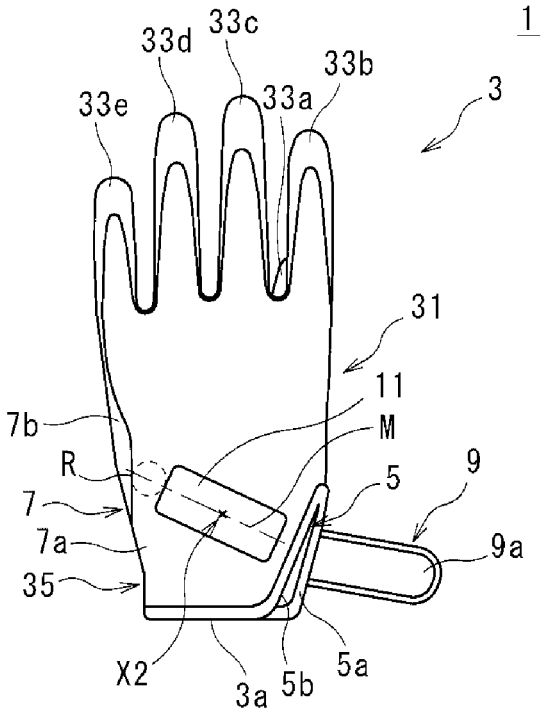
FIG. 1 is a schematic front view of a glove of an embodiment of the present invention.
Figure 4:
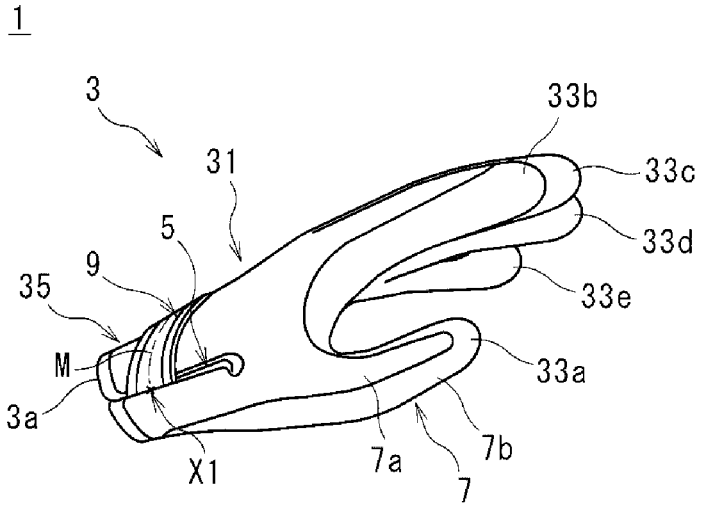
FIG. 4 is a schematic perspective view illustrating a general state of usage (a restricted state of a free end of a tongue piece) of the glove in FIG. 1.
Figure 2:
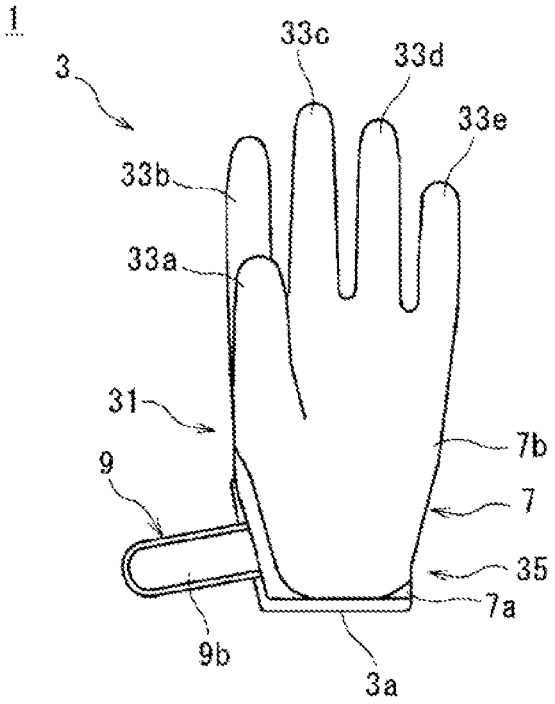
FIG. 2 is a schematic rear view of the glove in FIG. 1.
Figure 3:
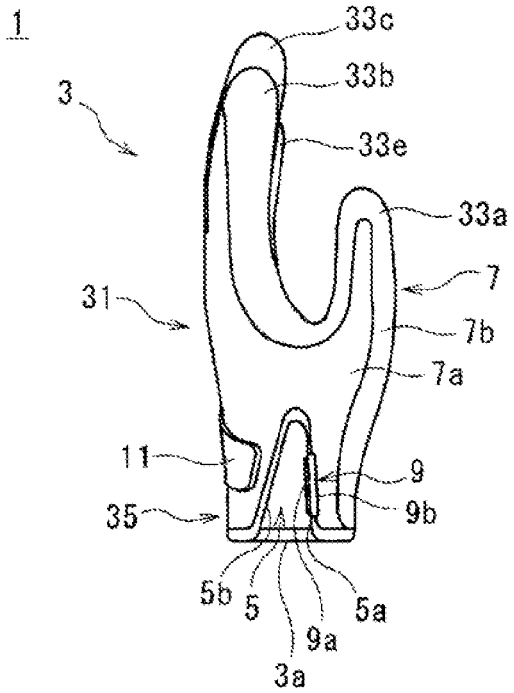
FIG. 3 is a schematic right-side view of the glove in FIG. 1.
Figure 5:
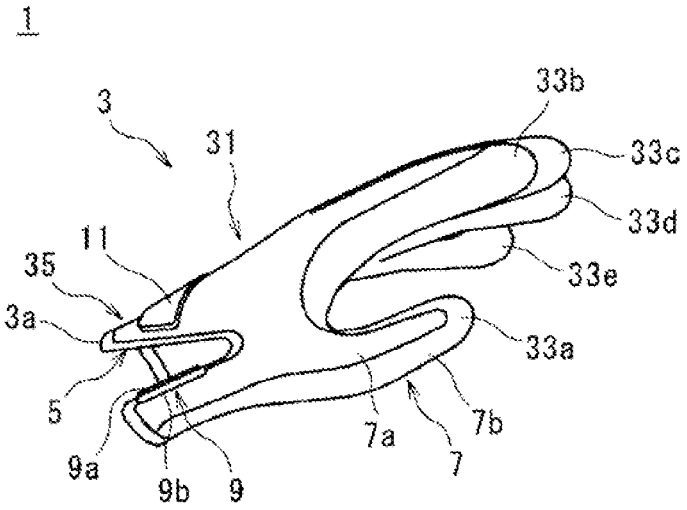
FIG. 5 is a schematic perspective view illustrating a general state of usage (a free state of the free end of the tongue piece) of the glove in FIG. 1.

A glove 1 illustrated in FIGS. 1 to 5 includes a glove main body 3 which covers a wearer's hand. The glove main body 3 has an opening 3*a* through which the hand can be inserted and removed. The opening 3*a* is a site into which the hand is inserted at a time of putting the glove 1 on the hand. As illustrated in FIGS. 1, 3, 5 and the like, a notch 5 extending from the opening 3*a* toward a fingertip side is formed in the glove main body 3 on a dorsal side of the hand with respect to a palm surface and on a thumb side with respect to a middle finger.

The glove 1 further includes a cover layer 7 made of a resin or a rubber which is overlaid on at least a palm region of an outer face of the glove main body 3.

The glove 1 further includes a tongue piece 9, one end of which is fastened to the glove main body 3 on the dorsal side of the hand with respect to the palm surface and on the thumb side with respect to the notch 5. An other end of the tongue piece 9 is a free end. The glove 1 further includes, on the dorsal side of the hand with respect to the palm surface and on a pinky finger side with respect to the notch, a restricting portion 11 capable of restricting movement of the free end of the tongue piece 9. The restricting portion 11 is configured to enable restricting such that the free end is positioned on the fingertip side with respect to the one end of the tongue piece 9.

Glove Main Body

The glove main body 3 is made of fibers and produced by knitting fibers into a glove shape. The glove main body 3 is stretchable. The glove main body 3 includes: a main body portion 31 formed in a pouch-like shape to cover the wearer's hand; extending portions 33*a*, 33*b*, 33*c*, 33*d*, and 33*e* extending from the main body portion 31 to cover the wearer's thumb (first finger), index finger (second finger), middle finger (third finger), ring finger (fourth finger), and pinky finger (fifth finger), respectively; and a cylindrical cuff portion 35 extending from the main body portion 31 in a direction opposite to the extending portions. The extending portions 33*a*, 33*b*, 33*c*, 33*d*, and 33*e* are each formed in a cylindrical shape with a closed fingertip portion. Furthermore, the cuff portion 35 has the opening 3*a* through which the wearer's hand can be inserted and removed.

The notch 5 is formed between a thumb portion and an index finger portion in a horizontal direction (in a direction orthogonal to a direction oriented from the cuff portion 35 toward the fingertip) in a front view (in a view from the dorsal side of the hand in a state in which the hand is wearing the glove 1 (see FIG. 1)). Here, a formation site of the notch 5 only needs to be on the thumb side with respect to a center line of the middle finger in the horizontal direction in the front view, may be positioned on a side face portion of the glove main body 3, and is preferably positioned on a hand dorsal portion of the glove main body 3. It is to be noted that the formation site of the notch 5 is preferably on the thumb side with respect to a site between the middle finger and the index finger (an extended line of an interdigital space between the middle finger and the index finger), and more preferably on the thumb side with respect to a center line of the index finger.

A length of the notch 5 is not particularly limited, and the lower limit of the length of the notch 5 is preferably 30 mm, and more preferably 45 mm. The upper limit of the length of the notch 5 is preferably 70 mm, and more preferably 65 mm.

In this embodiment, the notch 5 has a generally V-shape as illustrated in FIG. 3; however, the shape of the notch 5 is not limited hereto. The shape of the notch 5 is preferably a generally U-shape, a generally V-shape, a generally I-shape, or a shape between the generally U-shape and the generally V-shape. With the above shape, since the opening can be expanded, the hand can be easily inserted and removed. It is to be noted that as the shape of the notch 5, the generally U-shape is preferred to the generally I-shape, and the generally V-shape more preferred. In the case in which the shape of the notch 5 is the generally I-shape, when the glove 1 which is worn is tightened by the tongue piece 9, edges 5*a* and 5*b* of the notch 5 may overlap each other, bringing discomfort. In the case in which the shape of the notch 5 is the generally V-shape, unlike the case of the generally I-shape, the edges 5*a* and 5*b* of the notch 5 are less likely to overlap each other, and discomfort is more unlikely. In the case in which the shape of the notch 5 is the generally V-shape, by tightening one edge (the edge 5*a*) of the notch 5 in a direction of an other edge (the edge 5*b*), the tongue piece 9 is oriented in an oblique direction (in a restricted state in which the tongue piece 9 is restricted by the restricting portion 11, a direction oriented from the fastening site of the tongue piece 9 toward the restricted site thereof), enabling an improvement in fit. In the case in which the shape of the notch is the generally V-shape, as illustrated in FIG. 3, as compared to a point on the notch 5 which is the closest to the fingertip side (an intersection between the edge 5*a* and the edge 5*b*), a center point of an opening side (a bottom side of the notch 5) of the notch 5 (a midpoint between a point on an opening side of the edge 5*a* and a point on an opening side of the edge 5*b*) is preferably positioned on the dorsal side of the hand. Accordingly, fitting of the thumb, the index finger, and the pinky finger during work can be improved.

In the glove 1, an edge of the opening 3*a*, the edges 5*a* and 5*b* of the notch 5, and an edge of the tongue piece 5 are piped.

The fibers constituting the glove main body 3 are not particularly limited, and a natural fiber, a synthetic fiber, an inorganic fiber, and/or the like may be used. Examples of the natural fiber include cotton, silk, wool, hemp, and the like. Examples of the synthetic fiber include a polyethylene fiber, a polyester fiber, an aramid fiber, a super strong polyethylene fiber, a polyurethane fiber, a polyamide fiber, a rayon fiber, an acrylic fiber, and the like. Furthermore, examples of the inorganic fiber include a stainless fiber, a tungsten fiber, a glass fiber, and the like.

The glove main body 3 is formed using threads of the fibers. Examples of the threads include a spun yarn, a filament yarn, a textured yarn subjected to crimping and/or the like, and the like. Furthermore, one type of the fibers may be used for the threads, or two or more types thereof may be mixed. Examples of threads in which two types of fibers are mixed include a spun yarn being a blend of cotton and a polyester short fiber, and a composite yarn in which a stainless fiber is covered with nylon or the like.

Furthermore, the glove main body 3 may be formed by cutting and sewing a woven fabric, a knitted fabric, or a nonwoven fabric, each made of the fibers, into the shape of the glove 1; however, a seamless glove main body formed by knitting with a seamless knitting machine is preferred. When the glove main body 3 formed by knitting with the seamless knitting machine is used, the glove 1 is superior in production cost, flexibility, and wearing comfort. In the case in which the glove main body 3 is knitted with the seamless knitting machine, the number of knitting gauges of the glove main body 3 is preferably no less than 10 gauges and no greater than 26 gauges.

The lower limit of an average thickness of the glove main body 3 is preferably 0.1 mm, and more preferably 0.2 mm. Meanwhile, the upper limit of the average thickness of the glove main body 3 is preferably 1.3 mm, and more preferably 1.0 mm. When the average thickness of the glove main body 3 is less than the lower limit, strength of the glove 1 itself may be insufficient, and durability may be degraded. Conversely, when the average thickness of the glove main body 3 is greater than the upper limit, flexibility may decrease due to an increase in the thickness of the glove 1, and workability at a time of wearing may be degraded. It is to be noted that the average thickness is an average value of values obtained by measuring 5 arbitrary sites using a constant pressure thickness gauge conforming to JIS-L1086/L1096 (for example, "PG-15", available from TECLOCK Co., Ltd.) at a pressure load of 2.35 N.

It is to be noted that the glove main body 3 may be subjected to any of various types of treatments using a softener, a water and oil repellent agent, an antimicrobial agent, and/or the like, and may be provided with an ultraviolet protection function by, e.g., being coated or impregnated with an ultraviolet absorbing agent or the like. Furthermore, the fibers themselves to be used for the glove main body 3 may be impregnated with a chemical agent having such a function.

Cover Layer

The cover layer 7 constitutes the outer face of the glove main body 3. The cover layer 7 includes: an inner layer 7*a*, with at least a part of which the glove main body 3 being impregnated; and an outer layer 7*b* overlaid on at least a part of an outer face of the inner layer 7*a*. The cover layer 7 is stretchable.

The inner layer 7*a* is a coating film formed using a resin or a rubber as a material. The inner layer 7*a* is not particularly limited; in the present embodiment, the inner layer 7*a* is formed on an entire surface of the glove main body 3. It is to be noted that the inner layer 7*a* is preferably formed on at least the palm surface of the main body portion 31 and the extending portions 33*a*, 33*b*, 33*c*, 33*d*, and 33*e* of the glove main body 3, more preferably further formed to side face portions of the main body portion 31 and the extending portions 33*a*, 33*b*, 33*c*, 33*d*, and 33*e* of the glove main body 3, and particularly preferably further formed to hand dorsal portions of the extending portions 33*a*, 33*b*, 33*c*, 33*d*, and 33*e* of the glove main body 3 (on entire surfaces of the extending portions 33*a*, 33*b*, 33*c*, 33*d*, and 33*e*).

As the resin or the rubber that forms the inner layer 7*a*, for example, various known resins or rubbers such as a vinyl chloride resin, a natural rubber, a nitrile-butadiene rubber, a chloroprene rubber, a fluorine rubber, a silicone rubber, an isoprene rubber, polyurethane, and an acrylic resin, as well as modified products thereof (for example, a carboxyl-modified product) may be used; moreover, the various known resins or rubbers may be used in combination. The various known resins or rubbers may contain a generally used vulcanizing agent such as sulfur, a vulcanization accelerator such as zinc dimethyldithiocarbamate, a vulcanization accelerating aid such as zinc oxide, a cross-linker such as blocked isocyanate, a plasticizer or a softener such as mineral oil or phthalate ester, an antioxidant or an antiaging agent such as 2,6-di-t-butyl-4-methylphenol, a thickener such as an acrylic polymer or a polysaccharide, a blowing agent such as azodicarbonamide, a foaming agent or a foam stabilizer such as sodium stearate, an additive such as an anti-tack agent, e.g. paraffin wax, and a filler such as carbon black, calcium carbonate, or fine powdered silica. The inner layer 7*a* is generally formed to a thickness of no less than 0.2 mm and no greater than 2.0 mm. The thickness of the inner layer 7*a* can be determined by measuring heights at 20 arbitrary points in a cross section of the inner layer 7*a* in an oblique direction with respect to a knitting (weaving) direction of the glove main body 1, the 20 points being selected at random such that an interval between two adjacent points is at least 2 mm, by observation with a digital microscope (model VHX-900, manufactured by KEYENCE CORPORATION), for example, at a 100-fold magnification and by calculating an arithmetic average of the measured values. It is to be noted that a site having an extremely different thickness (for example, an extremely thick portion due to unintended dripping of the resin or the rubber, or the like) is excluded from the 20 arbitrary points.

The inner layer 7*a* is preferably a foam layer containing bubbles. Accordingly, flexibility and an amount of storable air can be increased.

The outer layer 7*b* is a coating film formed using a resin or a rubber as a material. The outer layer 7*b* is not particularly limited; in the present embodiment, the outer layer 7*b* is formed in an unlined state. Specifically, the outer layer 7*b* is formed on an entirety of the palm surface and the side face portion of the main body portion 31 of the glove main body 3, an entirety of the palm surface of the extending portions 33*a*, 33*b*, 33*c*, 33*d*, and 33*e* of the glove main body 3, an entirety of the side face portion and a fingertip portion of the hand dorsal portion (a site on the fingertip side with respect to a first joint (a distal joint)) of each of the extending portions 33*a*, 33*b*, 33*c*, 33*d*, and 33*e*), and a part of the cuff portion 35 on the palm side (a portion excluding a portion around the opening) (see FIGS. 1 to 3, and the like). It is to be noted that the outer layer 7*b* is preferably formed on at least the palm surface of the main body portion 31 and the extending portions 33*a*, 33*b*, 33*c*, 33*d*, and 33*e* of the glove main body 3, more preferably further formed to the side face portions of the extending portions 33*a*, 33*b*, 33*c*, 33*d*, and 33*e* of the glove main body 3, and particularly preferably further formed to the hand dorsal side of fingertip portions of the extending portions 33*a*, 33*b*, 33*c*, 33*d*, and 33*e* of the glove main body 3. Furthermore, it is preferred that the outer layer 7*b* is not formed on the hand dorsal portion of the main body portion 31 of the glove main body 3, and it is more preferred that the outer layer 7*b* is not formed on the hand dorsal portion on the opening side with respect to second joints (proximal joints) of the extending portions 33*a*, 33*b*, 33*c*, 33*d*, and 33*e*.

The outer layer 7*b* may be formed using a material similar to that of the inner layer 7*a* or may be formed using a material different from that of the inner layer 7*a*. In the case in which the material different from the material of the inner layer 7*a* is used as the material of the outer layer 7*b*, in light of increasing adhesiveness, an adhesive layer may be provided between the inner layer 7*a* and the outer layer 7*b*. The adhesive layer is formed using any of various types of known adhesives such as an acrylic-based adhesive, a urethane-based adhesive, and the like. The adhesive preferably has a dissolution parameter (an SP value) that is intermediate between an SP value of the material of the inner layer 7*a* and an SP value of the material of the outer layer 7*b*. The outer layer 7*b* is generally formed to a thickness of no less than 0.1 mm and no greater than 2.0 mm. The thickness of the outer layer 7*b* is measured in a manner similar to that of the thickness of the inner layer 7*a*.

The outer layer 7*b* is formed as a non-porous coating film. Accordingly, high strength is obtained. As referred to herein, "non-porous coating film" means a coating film in which no void is visually observed when a cross section of the film is observed with a digital microscope (model VHX-900, manufactured by KEYENCE CORPORATION) at a magnification of 100-fold. It is to be noted that a void due to unintended foam is ignored. Furthermore, the outer layer 7*b* may be formed using at least one type of resin or rubber selected from a natural rubber, a nitrile-butadiene rubber, a chloroprene rubber, an isoprene rubber, a fluorine rubber, a silicone rubber, a vinyl chloride resin, polyurethane, and an acrylic resin, as well as modified products thereof. Accordingly, antislipping performance is improved, and superior grip is obtained. Alternatively, the outer layer 7*b* may be formed using a resin or a rubber to which antislipping particles have been added.

Restricting Portion

The restricting portion 11 is constituted from one hook-and-loop fastener. The restricting portion 11 is fastened, by sewing, to a site at which the cover layer 7 is overlaid on the glove main body 3. It is to be noted that a fastening means of the restricting portion is not limited to sewing, and an adhesive and/or the like may also be used. The restricting portion 11 is fastened to a one-layer portion of the cover layer 7, the one-layer portion being composed of the inner layer 7*a* alone without the outer layer 7*b* being overlaid thereon.

The restricting portion 11 is formed in a generally rectangular shape in a front view. The restricting portion 11 is provided, in the horizontal direction in the front view, in a tilted state in which the pinky finger side is tilted toward the fingertip side with respect on the thumb side.

Tongue Piece

The tongue piece 9 is fastened to the cuff portion 35 of the glove main body 3. The tongue piece 9 is fastened, by sewing, to a site in which the cover layer 7 is overlaid on the glove main body 3. The tongue piece 9 is fastened to a one-layer portion of the cover layer 7, the one-layer portion being composed of the inner layer 7*a* alone without the outer layer 7*b* being overlaid thereon.

The tongue piece 9 has flexibility and is formed in a generally rectangular shape. The tongue piece 9 is fastened along an edge on the thumb side of the notch 5. The tongue piece 9 is fastened to the glove main body 3 so as to protrude in a generally perpendicular direction with respect to the edge 5*a* of the notch 5.

The tongue piece 9 includes an attaching/detaching portion 9*a* which is attachable to and detachable from the restricting portion 11. The attaching/detaching portion 9*a* is constituted from an other hook-and-loop fastener which is attachable to and detachable from the one hook-and-loop fastener, being the restricting portion 11. The other hook-and-loop fastener is provided on a surface that faces the restricting portion 11 in the restricted state, and is provided on substantially an entire surface of the tongue piece 9. The attaching/detaching portion 9*a* is formed in a shape that is generally identical to that of the restricting portion 11.

The tongue piece 9 further includes a flexible lining layer 9*b* which is overlaid on a rear face (a surface that does not face the restricting portion 11 in the wearing state) of the attaching/detaching portion 9*a* (the other hook-and-loop fastener). The lining layer 9*b* is not particularly limited and may be constituted from, for example, a fabric (for example, a woven fabric or a knit fabric), a resin layer, or a rubber layer, or may be a layered body of a plurality of types of layers. For example, the lining layer 9*b* may be a layered structure body constituted from: a urethane layer (a rubber layer) overlaid on the rear face of the other hook-and-loop fastener; and a cloth overlaid on a rear face of the urethane layer.

A bending stress of the tongue piece 9 in a direction in which the tongue piece 9 is released is preferably no greater than 3.0 N. When the bending stress is greater than 3.0 N, attachment and detachment (release from restriction) of the tongue piece 9 may be difficult. Furthermore, the bending stress of the tongue piece 9 in a direction in which the tongue piece 9 is restricted is preferably no greater than 2.0 N. When the bending stress is greater than 2.0 N, the tongue piece 9 may be difficult to restrict, and the tongue piece 9 may fail to be bent along the hand at a time of wearing, degrading the fit. It is to be noted that the bending stress is measured by a three-point bending test (testing speed: 5 mm/min, distance between supporting points: 20 mm, diameter of indenter: 4.5 mm, displacement: 10 mm after test piece contact) of a test piece (width: 30 mm, length: 70 mm) of the tongue piece 9, the three-point bending test being performed in accordance with JIS-K-7171 (2008). The lower limit of the bending stress of the tongue piece 9 in the direction in which the tongue piece 9 is released and the lower limit of the bending stress of the tongue piece 9 in the direction in which the tongue piece 9 is restricted are not particularly limited and are, for example, 0.1 N.

Relation between Fastening Site of Tongue Piece and Restricted Site Restricted by Restricting Portion In the glove 1, as described above, in a state in which the tongue piece 9 is restricted by the restricting portion 11, the free end (a center of the restricted site) is provided such that the free end is positioned on the fingertip side with respect to the one end (a center of the fastening site) of the tongue piece 9. Specifically, the fastening site of the tongue piece 9 is on the thumb side with respect to the restricting portion 11 in the horizontal direction in a front view, and is on the side of the cuff portion 35 with respect to the restricting portion 11 in the vertical direction in the front view. The fastening site of the tongue piece 9 is preferably positioned between a metacarpophalangeal joint of the thumb and a radial styloid process in the vertical direction in the front view. Furthermore, the fastening site of the tongue piece 9 and the restricted site at which the tongue piece 9 is restricted by the restricting portion 11 are arranged such that in a state in which the hand wears the glove 1 and the tongue piece 9 is restricted by the restricting portion 11, the notch 5 is closed as illustrated in FIG. 4 and a tensile force acts on the tongue piece 9 in a direction connecting the restricted site and the fastening site of the tongue piece 9. Accordingly, when the tongue piece 9 is in the state of being restricted by the restricting portion 11, a tightening force acts on the glove 1 in a longitudinal direction of the tongue piece 9 (in the horizontal direction in the front view, in a direction tilted to the fingertip side toward the pinky finger side). Accordingly, the fit of the glove 1 can be improved. An extended line of a line connecting the center of the fastening site of the tongue piece 9 and the center of the restricted site at which the tongue piece 9 is restricted by the restricting portion 11 preferably passes over a metacarpal of the pinky finger (a glove site corresponding to the metacarpal). By tightening the glove in this direction, the fitting of particularly the thumb, the index finger, and the pinky finger can be improved.

Furthermore, a tensile force of the glove 1 at a time of being stretched 100% (hereinafter, may be also referred to simply as a 100% tensile force) is not particularly limited. However, a 100% tensile force of a portion on the palm side, the portion facing the tongue piece 9 restricted by the restricting portion 11 in the above-described manner (referred to as a facing portion), of the glove 1 is preferably no greater than 40 N/cm, more preferably no greater than 20 N/cm, and still more preferably no greater than 12 N/cm. When the 100% tensile force of the facing portion is no greater than the upper limit, the portion on the palm side of the glove 1 is stretched at a time of pulling the tongue piece 9 on the dorsal side of the hand, enabling the tongue piece to be restricted without wrinkling the palm surface. Furthermore, when the 100% tensile force of the facing portion is no greater than the upper limit, the portion on the palm side of the glove 1 is stretched at the time of pulling the tongue piece 9 on the dorsal side of the hand, enabling the tongue piece 9 in that state to be restricted by the restricting portion 11; at this time, the tensile force being lower enables the glove 1 to be more easily and certainly stretched at the facing portion, improving the fit. It is to be noted that the 100% tensile force can be measured by pulling, in a length direction, a test piece having a width of 10 mm and a length of 70 mm at a distance between chucks of 40 mm and with a tensile speed of 100 mm/min.

In addition, when the glove main body 3 is seamless, during work with the glove worn, tension on the dorsal side of the hand due to a hand gripping action, a hand beckoning action, or the like can be alleviated by stretching a portion on the palm side, eliminating tightness and improving the fit.

Production Method of Glove

A production method of the glove in the above embodiment is described; the production method of the glove of the present invention is not limited thereto.

Figure 6:
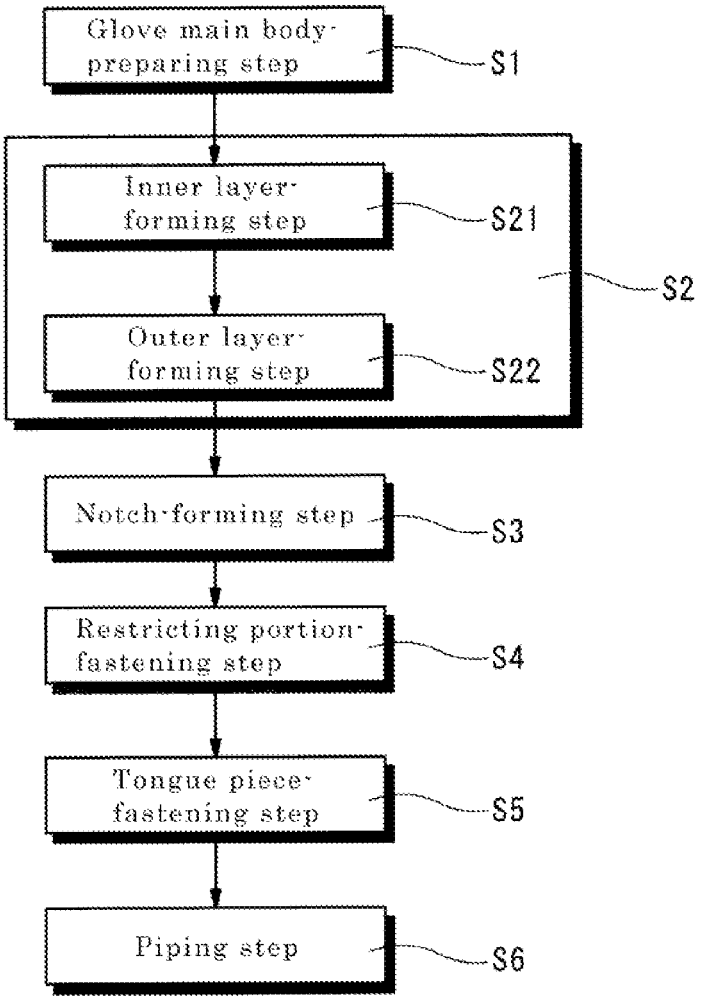
FIG. 6 is a flow chart illustrating a production method of a glove of an embodiment of the present invention.

The production method of the glove includes:

S1. a step of preparing a glove main body (a glove main body-preparing step);

S2. a step of forming a cover layer on the glove main body (a cover layer-forming step);

S3. a step of forming a notch in the glove main body on which the cover layer has been formed (a notch-forming step);

S4. a step of fastening a restricting portion to the glove main body on which the cover layer has been formed (a restricting portion-fastening step);

S5. a step of fastening a tongue piece to the glove main body on which the cover layer has been formed (a tongue piece-fastening step); and S6. a step of piping edges of an opening and the notch (a piping step) (see FIG. 6).

S1. Glove Main Body-Preparing Step

In the glove main body-preparing step S1, a glove main body is produced by knitting fibers into a glove shape. It is to be noted that separate preparation of a prefabricated glove main body, for example, by purchasing is also possible.

S2. Cover Layer-Forming Step

The cover layer-forming step S2 includes: a step of forming an inner layer on an outer face of the glove main body that has been prepared in the glove main body-preparing step (an inner layer-forming step S21); and a step of forming an outer layer on an outer face of the inner layer (an outer layer-forming step S22).

In the inner layer-forming step S21, a first coating liquid containing a resin or a rubber for forming the inner layer is applied on at least a part of the outer face of the glove main body fitted onto a hand mold. The hand mold is any of various types of known hand molds made of ceramics, metals, and the like. The first coating liquid is a liquid containing the resin or the rubber. Examples of the resin or the rubber include the aforementioned various types of known resins or rubbers. A suitable resin or rubber of the various types of known resins or rubbers may be used in accordance with the purpose. For example, in a case in which improvement in strength of the inner layer and/or ease of processing is/are intended, a latex such as a natural rubber, a nitrile-butadiene rubber, or the like is preferably used. In this case, the first coating liquid is prepared such that a solid content ratio is no less than 20% by mass and no greater than 60% by mass. The solid content ratio is adjusted using water and/or the like. The first coating liquid may contain colloidal sulfur. In the case of using the latex as the resin or the rubber in the first coating liquid, a content of the colloidal sulfur is preferably no less than 0.1 parts by mass and no greater than 2.0 parts by mass with respect to 100 parts by mass of a solid content of the latex. Furthermore, the first coating liquid may contain a vulcanization accelerator. Examples of the vulcanization accelerator include zinc dibutyldithiocarbamate, zinc diethyldithiocarbamate, zinc dibenzyldithiocarbamate, tetramethylthiuram monosulfide, and the like. In the case of using the latex as the resin or the rubber in the first coating liquid, a content of the vulcanization accelerator is preferably no less than 0.1 parts by mass and no greater than 2.0 parts by mass with respect to 100 parts by mass of the latex solid content. Furthermore, the first coating liquid may contain zinc oxide. In the case of using the latex as the resin or the rubber in the first coating liquid, a content of the zinc oxide is preferably no less than 0.1 parts by mass and no greater than 2.0 parts by mass with respect to 100 parts by mass of the latex solid content. Furthermore, the first coating liquid may contain a thickening agent. Examples of the thickening agent include a cellulose-based thickening agent, an acrylic polymer, a silica-based thickening agent, and the like. A content of the thickening agent is appropriately adjusted in accordance with an intended viscosity. In a case of measurement using a B-type viscometer (for example, "TVB-10", manufactured by Told Sangyo Co., Ltd.) under V6 conditions (rotation frequency: 6 rpm, temperature: 25° C.), a viscosity of the first coating liquid is preferably no less than 1,000 mPa·s and no greater than 4,000 mPa·s.

As a method for applying the first coating liquid, any of various types of known coating methods such as shower coating, dip coating, and the like may be employed; in light of facilitating stable and uniform application of the coating liquid, dip coating is preferably employed. The dip coating may be performed by dipping, for a predetermined time in the first coating liquid with which a bathtub has been filled in advance, the outer face of the glove main body 3 on which the inner layer is to be formed, and then removing the glove main body from the first coating liquid.

In light of suppressing penetration of the first coating liquid into a deep portion of a gap between the fibers of the glove main body, various types of anti-penetration treatments are preferably performed on the outer face of the glove main body on which the first coating liquid is to be applied. Examples of the anti-penetration treatments include coagulating agent-coating, a water repellent treatment, an oil repellent treatment, and the like. Examples of a coagulating agent used in the coagulating agent-coating include salts of multivalent cations such as calcium nitrate and zinc chloride, as well as organic acids such as acetic acid and citric acid; examples of a solvent of the coagulating agent include water, methanol, and the like. Examples of a water repellent used in the water repellent treatment include a silicone-based treatment agent and a fluorine-based treatment agent; examples of an oil repellent used in the oil repellent treatment include a fluorine-based treatment agent. The anti-penetration treatment(s) may be performed alone or in combination. To improve an effect of the anti-penetration treatment(s), in the case of measurement using a B-type viscometer under V6 conditions, the viscosity of the first coating liquid is preferably increased to no less than 2,000 mPa·s.

The glove main body on which the first coating liquid has been applied is dried using a heater such as an oven or the like, and thus an inner layer, with at least a part of which the glove main body is impregnated, is formed on the outer face of the glove main body.

In the outer layer-forming step S22, a second coating liquid containing a resin or a rubber for forming the outer layer is applied on at least a part of the outer face (the outer face of the inner layer) of the glove main body, on the outer face of which the inner layer has been formed. Examples of the resin or the rubber contained in the second coating liquid include the aforementioned various types of known resins or rubbers. A suitable resin or rubber of the various types of known resins or rubbers may be used in accordance with the purpose. For example, in a case in which improvement in strength of the outer layer and/or ease of processing is/are intended, a latex such as a natural rubber, a nitrile-butadiene rubber, or the like is preferably used. In this case, the second coating liquid is prepared such that a solid content ratio is no less than 20% by mass and no greater than 60% by mass. The solid content ratio is adjusted using water and/or the like. Furthermore, the second coating liquid may contain any of various types of compounding agents that are similar to those exemplified for the first coating liquid at proportions that are similar to those exemplified for the first coating liquid. In a case of measurement using a B-type viscometer under V6 conditions, a viscosity of the second coating liquid is preferably no less than 500 mPa·s and no greater than 4,000 mPa·s.

The second coating liquid is applied on the palm side of the glove main body and on the dorsal side of the hand by a method similar to that in the case of the first coating liquid so as to cover at least a part of the outer face of the inner layer. In light of facilitating stable and uniform application of the second coating liquid, as in the case of the first coating liquid, dip coating is preferably employed as a coating method.

In a case in which the resin or the rubber contained in the second coating liquid is different from the resin or the rubber contained in the first coating liquid, an adhesive layer is preferably provided on the outer face of the inner layer on which the second coating liquid is to be applied. The adhesive layer may be formed by applying any of various types of known adhesives such as an acrylic-based adhesive, a urethane-based adhesive, and the like by shower coating, spray coating, dip coating, or the like. The adhesive may be dried after the application. Furthermore, an antislipping pattern may be formed on the outer layer by any of various types of known methods. For example, an antislipping pattern may be formed in such a manner that hygroscopic particles are brought, for a predetermined time, into contact with a surface of the second coating liquid that has been applied, and then the hygroscopic particles are removed by cleaning, or a swelling pattern (a pattern resulting from a swelling action) may be formed in such a manner that the surface of the second coating liquid that has been applied is dried to a predetermined state, and then the surface of the second coating liquid, after the drying, is dipped in an organic solvent. In light of ease in forming the antislipping pattern, the method of dipping in the organic solvent is preferred.

The glove main body on which the second coating liquid has been applied is dried using a heater such as an oven or the like, and thus an outer layer is formed on at least the part of the outer face of the inner layer. It is to be noted that in a case in which a chemical such as the coagulating agent has been used, the glove main body on which the outer layer has been formed may be cleaned with water and/or the like to remove the excess chemical.

S3. Notch-Forming Step

The notch-forming step S3 is a step of forming, on the dorsal side of the hand with respect to the palm surface of the glove main body on which the cover layer has been formed in the cover layer-forming step S2 and on the thumb side with respect to the middle finger, a notch extending from the opening toward the fingertip side.

S4. Restricting Portion-Fastening Step

The restricting portion-fastening step S4 is a step of, by means of sewing, fastening a hook-and-loop fastener as a restricting portion to the outer face on the glove main body in which the notch has been formed in the notch-forming step S3. It is to be noted that the restricting portion-fastening step S4 may be performed prior to the notch-forming step S3.

S5. Tongue Piece-Fastening Step

The tongue piece-fastening step S5 is a step of, by means of sewing, fastening one end of the tongue piece to an edge of the notch of the glove main body to which the restricting portion has been fastened in the restricting portion-fastening step S4. It is to be noted that the tongue piece-fastening step S5 may be performed prior to the restricting portion-fastening step S4. Furthermore, the tongue piece-fastening step S5 may be performed prior to the notch-forming step S3; however, to easily and certainly fasten the tongue piece along the edge of the notch, the tongue piece-fastening step S5 is preferably performed after the notch-forming step S3.

S6. Piping Step

The piping step S6 is a step of piping each of the edges of the opening and the notch of the glove main body to which the tongue piece has been fastened in the tongue piece-fastening step S5. It is to be noted that an edge of the tongue piece may also be piped in the piping step S6, and the edge of the tongue piece may be piped before the tongue piece-fastening step S5. Furthermore, the piping step S6 may be performed prior to the restricting portion-fastening step S4 and the tongue piece-fastening step S5. However, to easily and certainly fasten the tongue piece along the edge of the notch and to easily and certainly perform the piping, the piping step S6 is preferably performed after the tongue piece-fastening step S5.

Advantages

In the glove 1, when the tongue piece 9 is in a free state, the opening 3*a* can be expanded owing to the presence of the notch 5, and the hand can be thus easily and certainly inserted and removed. Furthermore, by bringing, after insertion of the hand, the glove 1 into a state in which the tongue piece 9 is restricted, the glove 1 can be worn on the hand in a state in which expansion of the opening 3*a* is suppressed. In the glove 1, the one end of the tongue piece 9 is fastened to the glove main body 3 on the thumb side with respect to the notch 5, and the free end of the tongue piece 9 can be restricted by the restricting portion 11 so as to be positioned on the fingertip side with respect to the one end; accordingly, in the restricted state, an actual wearing position of the glove with respect to the hand is less likely to shift from a suitable position. In other words, by wearing the glove 1 such that a portion on the thumb side and the opening side of the glove main body 3 and a portion on the pinky finger side and the fingertip side of the glove main body 3 are tightened on the dorsal side of the hand by the tongue piece 9, a wearing state with an appropriate fit, in which a thumb portion, an index finger portion, and a middle finger portion are less likely to be misaligned with the respective fingers, can be obtained.

Other Embodiments

The present invention is not limited to the above embodiments and may be carried out in various modified and improved modes in addition to the aforementioned modes.

In the above embodiment, the coated glove in which the glove main body is coated with the cover layer, which includes the inner layer and the outer layer, is described; however, the present invention is not limited thereto, and the cover layer is not an essential component. Furthermore, even in a case in which the glove further includes a cover layer made of a resin or a rubber which is overlaid on at least the palm region of the outer face of the glove main body, the cover layer is not limited to the two-layer cover layer including the inner layer and the outer layer. It is to be noted that when the cover layer includes: the inner layer overlaid on the glove main body in a state in which the glove main body is impregnated with at least the part of the inner layer; and the outer layer overlaid on at least the part of the outer face of the inner layer, a glove suited for various usages can be obtained, wherein, for example, the inner layer serves as a layer having water resistance, and the outer layer serves as a layer demonstrating abrasion resistance, an antislipping function, and/or the like.

Figure 7:
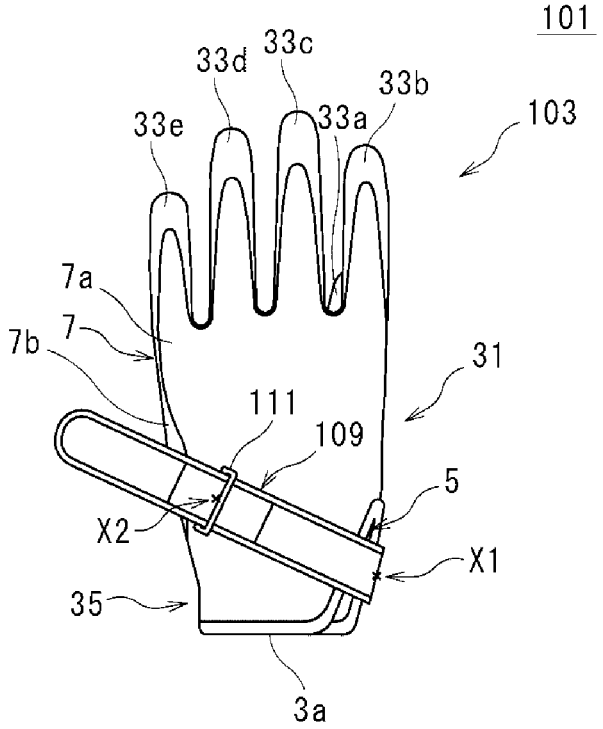
FIG. 7 is a schematic front view of a glove of another embodiment of the present invention and illustrates a free state of a free end of a tongue piece.
Figure 8:
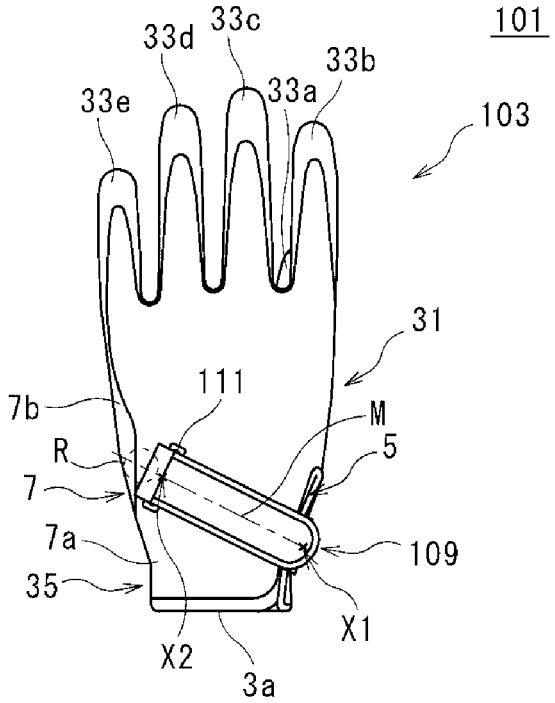
FIG. 8 is a schematic front view of the glove in FIG. 7 and illustrates a restricted state of the free end of the tongue piece.

Furthermore, in the above embodiment, the pair of the hook-and-loop fasteners is used for restricting the tongue piece by the restricting portion; however, the present invention is not limited thereto, and various attaching and detaching means may be used. For example, as illustrated in FIGS. 7 and 8, a ring-shaped member such as a D-ring which is fastened to a glove main body 103 may be employed as a restricting portion 111. In a glove 101 illustrated in FIGS. 7 and 8, a restricted state in which the tongue piece 109 is restricted by the restricting portion 111 can be obtained in the following manner: the tongue piece 109 is inserted into the ring-shaped member, a tip of the tongue piece 109 is folded back to a side of one end of the tongue piece 109, a pair of hook-and-loop fasteners is provided at portions at which the hook-and-loop fasteners face each other when the tongue piece 109 is folded back, and the hook-and-loop fasteners are engaged with each other. It is to be noted that in the glove 101 illustrated in FIGS. 7 and 8, components having structures and functions that are similar to those of the components of the glove 1 illustrated in FIGS. 1 to 5 are denoted by identical reference symbols.

Moreover, even in a case in which a hook-and-loop fastener is employed as the restricting portion, a pair of hook-and-loop fasteners does not need to have an identical shape, unlike the above embodiment. For example, the hook-and-loop fastener serving as the restricting portion may have an area that is greater than an area of a hook-and-loop fastener of the tongue piece.

Furthermore, in the above embodiment, the case in which the edge of the opening, the edge of the notch, and the edge of the tongue piece are piped is described; however, the present invention is not limited thereto. It is to be noted that the tongue piece can be easily attached and detached by piping the edge of the tongue piece; however, in a case in which a hook-and-loop fastener is employed as the restricting portion, a piped portion cannot be restricted by the restricting portion, and it is thus preferred that the tongue piece is not piped in a case in which a force is necessary for restricting the tongue piece.

INDUSTRIAL APPLICABILITY

As explained in the foregoing, the glove of the present invention can be suitably used as a work glove for use in work at a factory or the like, in a carrying task, in an agricultural job, and the like.

EXPLANATION OF THE REFERENCE SYMBOLS

1, 101 Glove
3, 103 Glove main body
3*a* Opening
5 Notch
5*a* Edge on palm side
5*b* Edge on dorsal side of hand
7 Cover layer
7*a* Inner layer
7*b* Outer layer
9, 109 Tongue piece
9*a* Attaching/detaching portion
9*b* Lining layer
11, 111 Restricting portion
31 Main body portion
33*a* First finger portion (extending portion)
33*b* Second finger portion (extending portion)
33*c* Third finger portion (extending portion)
33*d* Fourth finger portion (extending portion)
33*e* Fifth finger portion (extending portion)
35 Cuff portion

The invention claimed is:

1. A glove comprising:

a glove main body having an opening through which a wearer's hand is able to be inserted and removed and a notch which extends from the opening toward a fingertip side, the glove main body covering the hand;

a tongue piece, one end of which is fastened to the glove main body on a dorsal side of the hand with respect to a palm surface and on a thumb side with respect to the notch, and an other end of which is a free end; and a restricting portion which is fastened to the glove main body and is capable of restricting movement of the free end of the tongue piece on the dorsal side of the hand with respect to the palm surface and on a pinky finger side with respect to the notch, wherein a fastening site of the tongue piece is on a cuff portion side with respect to the restricting portion in a vertical direction in front view, on the dorsal side of the hand with respect to the palm surface and on the thumb side with respect to a center line of an index finger, the notch, having a generally V-shape and extending from the opening toward the fingertip side, is formed in the glove main body, the restricting portion is configured to enable restricting such that the free end is positioned on the fingertip side with respect to the one end of the tongue piece, in a state in which the tongue piece is restricted by the restricting portion, an extended line of a line connecting a center of the fastening site of the one end of the tongue piece and a center of a restricted site of the free end of the tongue piece passes over a glove site which is configured to correspond to a metacarpal of a pinky finger at a time of wearing, the restricting portion is one hook-and-loop fastener, the tongue piece comprises an attaching/detaching portion including an other hook-and-loop fastener which is attachable to and detachable from the one hook-and-loop fastener, and a bending stress of the tongue piece in a direction in which the tongue piece is restricted is no greater than 2.0 N.

2. The glove according to claim 1, wherein the glove main body is made of fibers, and the glove further comprises a cover layer made of a resin or a rubber which is overlaid on at least a palm region of an outer face of the glove main body.

3. The glove according to claim 2, wherein the one end of the tongue piece is fastened, by sewing, to a site of the glove main body on which the cover layer is overlaid.

4. The glove according to claim 1, wherein the glove main body is seamless.

* * * * *